US010858937B2

(12) United States Patent
Crompton et al.

(10) Patent No.: US 10,858,937 B2
(45) Date of Patent: Dec. 8, 2020

(54) ADAPTED ROCK BOLT WITH IMPROVED INSTALLATION PROPERTIES

(71) Applicant: EPIROC DRILLING TOOLS AB, Fagersta (SE)

(72) Inventors: Brendan Robert Crompton, Johannesburg (ZA); Cornelius Adriaan Nieuwenhuis, Johannesburg (ZA); James William Sheppard, Johannesburg (ZA); Henri Visser, Johannesburg (ZA)

(73) Assignee: EPIROC DRILLING TOOLS AB, Fagersta (SE)

( * ) Notice: Subject to any disclaimer, the term of this patent is extended or adjusted under 35 U.S.C. 154(b) by 0 days.

(21) Appl. No.: 16/634,238

(22) PCT Filed: Sep. 14, 2017

(86) PCT No.: PCT/ZA2017/000010
§ 371 (c)(1),
(2) Date: Jan. 27, 2020

(87) PCT Pub. No.: WO2019/023719
PCT Pub. Date: Jan. 31, 2019

(65) Prior Publication Data

US 2020/0157939 A1 May 21, 2020

(30) Foreign Application Priority Data

Jul. 26, 2017 (ZA) ..... 2017/05076
Aug. 17, 2017 (ZA) ..... 2017/05575

(51) Int. Cl.
*E21D 21/00* (2006.01)
*E21D 20/02* (2006.01)

(52) U.S. Cl.
CPC ..... *E21D 21/0026* (2013.01); *E21D 21/0006* (2013.01); *E21D 20/02* (2013.01)

(58) Field of Classification Search
CPC ..... E21D 21/0066; E21D 21/0026; E21D 21/0006; E21D 20/02
See application file for complete search history.

(56) References Cited

U.S. PATENT DOCUMENTS 4,360,292 A * 11/1982 Keeler ..... E02D 5/808 405/239
4,955,219 A 9/1990 Josef et al.
(Continued)

FOREIGN PATENT DOCUMENTS

AU 2016100070 A4 3/2016
DE 3504543 C1 5/1986
(Continued)

OTHER PUBLICATIONS

International Search Report and Written Opinion, dated Apr. 23, 2018, from corresponding PCT application No. PCT/ZA2017/000010.

*Primary Examiner* — Benjamin F Fiorello
(74) *Attorney, Agent, or Firm* — Nixon & Vanderhye

(57) ABSTRACT

Disclosed is a grout anchored rock bolt which includes an elongate cylindrical body of a suitable material which has at least one integral anchor portion which includes of a plurality projection, each of which extends laterally from the body in at least one radial direction, wherein the projections are consecutively serially arranged along the length of the anchor portion and wherein each projection is radially offset relatively to the preceding formation at an angle that is not orthogonal.

17 Claims, 8 Drawing Sheets

(56) References Cited

U.S. PATENT DOCUMENTS

| | | | | |
|---|---|---|---|---|
| 5,054,146 | A * | 10/1991 | Wiesenfeld | B21B 1/163 405/259.5 |
| 6,447,228 | B1 | 9/2002 | Fergusson | |
| 8,240,958 | B2 * | 8/2012 | Eigemann | E21D 20/025 405/259.5 |
| 2003/0031525 | A1 * | 2/2003 | Fergusson | F16B 15/00 411/82 |
| 2005/0134104 | A1 | 6/2005 | Simmons et al. | |
| 2005/0158127 | A1 * | 7/2005 | Fergusson | E21D 21/008 405/259.5 |
| 2015/0043976 | A1 * | 2/2015 | Defossez | E21D 21/0026 405/259.5 |
| 2016/0177718 | A1 | 6/2016 | Cawood | |
| 2017/0342836 | A1 | 11/2017 | Cawood | |

FOREIGN PATENT DOCUMENTS

| | | | |
|---|---|---|---|
| GB | 2241998 | A | 9/1991 |
| WO | 9961749 | A1 | 12/1999 |
| WO | 2010074584 | A1 | 7/2010 |
| WO | 2015089525 | A2 | 6/2015 |

* cited by examiner

ADAPTED ROCK BOLT WITH IMPROVED INSTALLATION PROPERTIES

FIELD OF THE INVENTION

The invention relates to a rock bolt which is adhered in a rock hole by a resinous or cementitious adhesive and which has improved grout mixing, grout anchoring and installation stiffness properties.

BACKGROUND OF THE INVENTION

Two discrete yet interrelated parameters come into play when ascribing load support capacity to a rock bolt which is adhered into a rock hole by a grout or resin (Hereinafter the words "grout" and "resin" are used interchangeably to refer to a rock bolt or anchor that is adhered in a rock hole by a resinous or cementitious adhesive), namely anchoring and stiffness.

The ability of the rock bolt to anchor into an annular column of grout without moving relatively to the grout column, when placed under load, describes anchoring. This parameter ultimately is the limiting factor in a grouted rock bolt installation.

The degree to which the rock bolt, and encasing grout column, axially deflects, moves or slips relatively to the support rock, again when placed under load, is referred to as installation stiffness or stiffness.

For a resin or grout encapsulated rock bolt to be effective, the annulus, i.e. the thickness, of resin between the installed rock bolt and the rock hole walls must meet tight limits as set by the manufacturer of the resin or grout. This is by virtue of the fact that a particular resin will have a specific modulus of elasticity ("modulus"). Notwithstanding the specific modulus, generally, increasing the thickness will decrease the stiffness of the installation.

Because of these limits, the range of hole-sizes in which a rock bolt can be installed, without compromising on support capacity, is also limited. These imitations lead to at least one practical problem which plays out when a required minimum hole diameter cannot be achieved because of inherent imitations imposed by the drill machinery.

In narrow sloping operations where multiple lengths of drill steel are required to achieve the desired hole length, the couplings connecting each successive drill steel limit the minimum hole size. In such an instance an unnecessarily large diameter rock bolt is required to maintain the resin annulus specifications. If this is not done, and the intended smaller diameter rock bolt is installed, the installation is below specification and potentially is not safe. However, the larger diameter rock bolt is superfluous to the desired tensile support capacity requirements based on the type and mass of rock to be supported. This leads to a more inefficient and costly support installation.

Another factor that affects stiffness is the density of the resin around the bolt, especially about the most vital part of the bolt, being a leading end portion of the bolt, the focal point of the support provided by the bolt. The presence of voids or bubbles reduces the density and, ultimately, reduces the stiffness.

An earlier patent specification WO2015/089525 describes a rock bolt which has an elongate cylindrical body made from a suitable steel material and which has an integral anchor portion comprising of a plurality of paddle formations for anchoring the bolt in the grout column.

The integral anchor portion of the bolt is comprised of a series of paddle formations, each of which extend laterally from the cylindrical surface of the body, and each of which is radially offset relatively to adjacent formations at 90°. Each of these paddle formations has a longitudinal axis that is aligned to the elongate axis of the body. In this orientation, the opposed faces of each paddle formation are perpendicularly presented to the rotational direction of the rock bolt when spun.

Thus, when the bolt is spun through the resin, a cavitation phenomenon occurs behind the trailing face of each paddle. This is due to the viscous nature of the resin and its inability to move in laminar flow to optimally fill the area behind trailing face. Due to the viscosity of the resin, the rotational velocity of the bolt and the front-on presentation of the leading face, the resin is prone to turbulent flow around each paddle, creating bubbles and voids. The voids are especially prevalent behind the trailing face.

Not only does this cavitation phenomenon reduce stiffness, it also allows corrosive agents to penetrate through to the surface of the bolt, accelerating corrosion.

The present invention at least partially addresses the aforementioned problems.

SUMMARY OF THE INVENTION

In a first aspect, the invention provides a grout anchored rock bolt which includes an elongate cylindrical body of a suitable material which has at least one integral anchor portion which comprises of a plurality projections, each of which extends laterally from the body in at least one radial direction, wherein the projections are consecutively serially arranged along the length of the anchor portion and wherein each projection is radially offset relatively to the preceding formation at an angle that is not orthogonal.

The material may be a suitable metal material.

Each projection may be a lobed formation, aligned in the longitudinal axis of the body, and extending laterally from the body in one radial direction.

Each projection may be a paddle formation, aligned in the longitudinal axis of the body, which extends laterally from the body in two diametrically opposed radial directions.

Preferably, the integral anchor portion comprises either three or four paddle formations radially offset in a range 55° to 65° and 40° to 50° respectively. More preferably, the integral anchor comprises four paddle formations radially offset at 45°. Alternatively, the integral anchor comprises three paddle formations radially offset at 60°

The body may include a first and a second integral anchor portion.

The first anchor portion may be positioned towards a first end of the body and the second anchor portion may positioned towards a second end of the body.

In an second aspect, the invention provides a grout anchored rock bolt which includes an elongate cylindrical body of a suitable steel material which has at least one integral anchor portion which comprises of a plurality of serially arranged paddle formations, to provide opposed first and second faces and opposed first and second edges separating the faces, wherein each formation is radially offset relatively to the preceding formation at an angle that is not orthogonal and wherein the edges follow a helical pattern.

Each paddle formation may extend laterally from the body in two diametrically opposed radial directions The plurality of serially arranged paddle formations may be consecutively serially arranged.

Preferably, the plurality of paddle formations are equidistantly radially offset.

Preferably, the integral anchor portion comprises either three or four paddle formations radially offset in a range 55° to 65° and 40° to 50° respectively. More preferably, the integral anchor comprises four paddle formations radially offset at 45°. Alternatively, the integral anchor comprises three paddle formations radially offset at 60°.

The body may include a first and a second integral anchor portion.

The first anchor portion may be positioned towards a first end of the body and the second anchor portion may positioned towards a second end of the body.

The invention provides a first method of manufacturing a paddle adapted rock bolt with improved grout installation properties which includes the steps of:

(a) providing an elongate cylindrical body of a suitable steel material;

(b) flattening the body at intervals along a length of the body to form a plurality of paddle formations, all of which extend laterally from the body in a single plane; and (c) twisting the body about its elongate axis to twist the paddle formations out of the single plane.

Preferably, the plurality of peddle formations comprises either three or four paddle formations.

If the rock bolt includes three paddle formations, the body may be twisted in step (c) to an extent where a lateral centre of a third paddle formation of the plurality is offset at 120° relatively to a first paddle formation of the plurality.

If the rock bolt includes four paddle formations, the body may be twisted in step (c) to an extent where a lateral centre of a fourth paddle formation of the plurality is offset at 135° relatively to a first paddle formation of the plurality.

The invention provides a second method of manufacturing a paddle adapted rock bolt with improved grout installation properties which includes the steps of.

(a) providing an elongate cylindrical body of a suitable steel material;

(b) providing a pair of dies of a forming tool in which the dies are complementarily shaped with a twisted surface;

(c) pressing the body at a first location between the pair of dies to provide a first paddle formation with opposed faces, each with a curved or twisted surface;

(d) turning the body about its elongate axis through an angle that is not orthogonal; and (e) pressing the body at a second location between the pair of dies to provide a second paddle formation with opposed faces, each with a twisted surface.

Steps (c) to (e) may be repeated to provide a third paddle formation.

In providing a paddle adapted rock bolt with three paddle formations, the body may be turned each time through 60°.

Steps (c) to (e) may be repeated to provide a third and a fourth paddle formation.

In providing a paddle adapted rock bolt with four paddle formations, the body may be turned each time through 45°.

BRIEF DESCRIPTION OF THE DRAWINGS

The invention is further described by way of example with relevance to the accompanying drawings in which:

FIGS. 2A, 28 and 2C illustrate a second embodiment of the grout anchored rock bolt of the first aspect of the invention showing a leading end portion of the rock bolt respectively in elevation, perspective and in plan;

DESCRIPTION OF PREFERRED EMBODIMENT

Figure 1A:
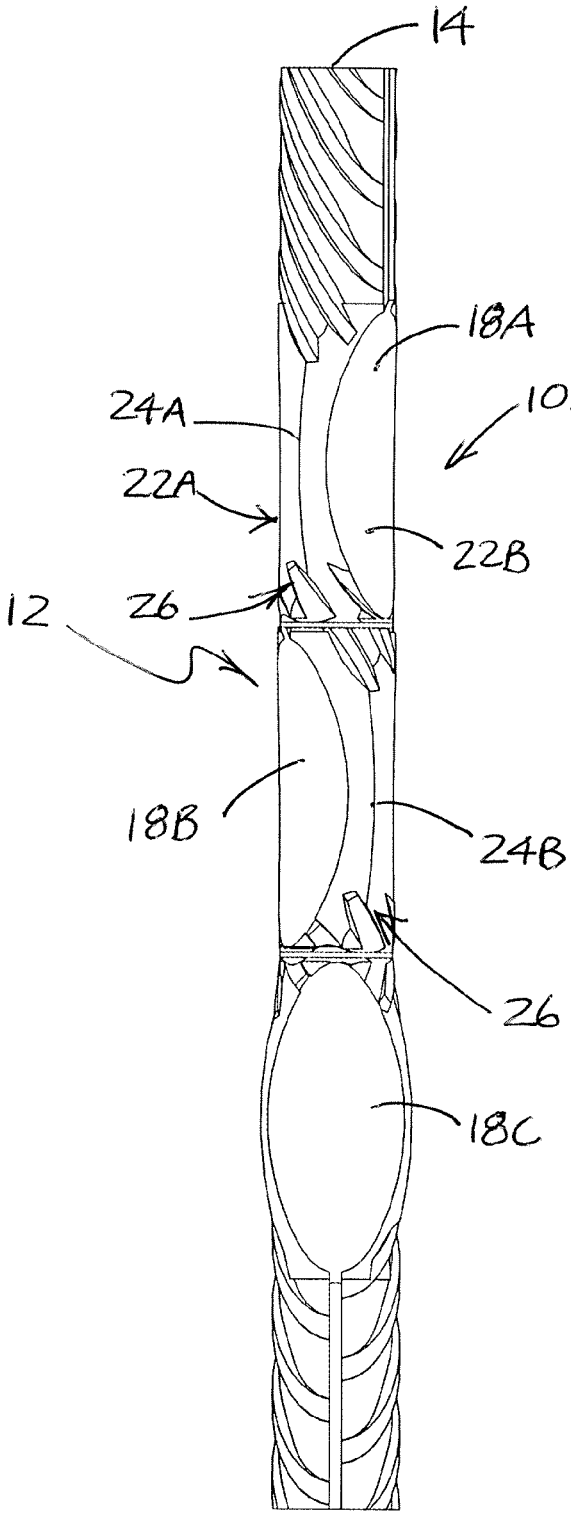
FIGS. 1A, 1B and 1C illustrates a first embodiment of a first aspect of the invention being a grout anchored rock bolt showing a leading end portion of the rock bolt respectively in elevation, perspective and in plan.
Figure 1B:
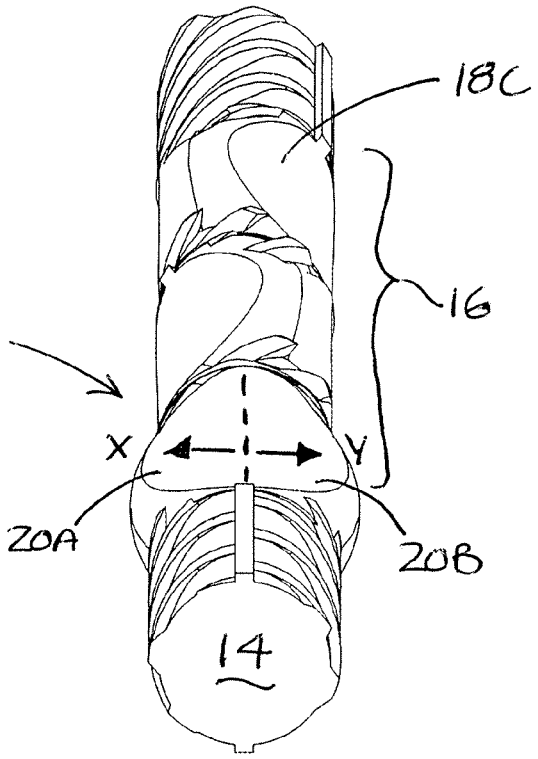
Figure 1C:
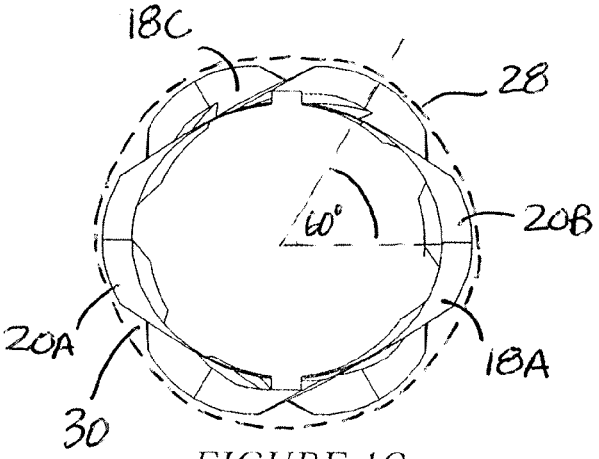

FIGS. 1A to 1C illustrate a rock bolt 10A in accordance with a first embodiment of a first aspect of the invention which, in use, is adhered in a rock hole by a resinous or cementitious adhesive.

The rock bolt 10A has a solid cylindrical steel body 12, which extends between a first distal end 14 and an opposed end (not shown) which latter end will, in use, project from a rock hole in which the bolt is placed as will be described more fully below. The surface of the bolt can be profiled, as illustrated, for increased resistive interaction with the grout in use or smooth for yielding along the smooth portions.

Between the ends the body has an integral anchor portion 16. This single anchor portion preferably is biased towards the distal end 14. This portion comprises a series of end-to-end, or consecutive serial, paddle formations. The formations are respectively designated 18A, and 18B and 18C. It is contemplated however that the bolt can have two integral anchor portions; a first portion biased towards the distal end and a second portion biased towards the opposed end.

Each paddle formation 18 is formed by flattening the body 12, in a suitable cold forming process, such that the body expands in opposed directions which are orthogonal to the direction of the flattening force. This flattening process adapts the cylindrical rock bolt body to locally exceed its diameter in two diametrically opposed radial directions, X and Y (see FIG. 1B) respectively, providing lobed extensions about a central axial line (dotted line in FIG. 1B) which are respectively designated 20A and 20B on paddle formation 18A. The length of each paddle formation is aligned with the longitudinal axis of the body.

Each paddle formation has a first face and a second face, respectively designated 22A and 228, and opposed first and second edges, respectively designated 24A (on peddle 18A) and 24B (on paddle 188), which separate the faces. Each lobe 20 of each paddle formation 18 has a grout pressing surface 26 which is at a trailing end of each edge.

The paddle formations as described above is a non-limiting example. It is anticipated within the scope of the invention that the anchor portion 16 can comprise of a series of lobed formations which are not paddle formations in that they only extend laterally from the surface of the body 12 in one radial direction.

Whilst paddle formations of the type described above are known in the art, these paddle formations are orthogonally offset from one another. In the present invention, the paddle formations 18 are not orthogonally offset. In this embodiment 10A, the formations are radially offset by 60°. This offset or phase rotation is illustrated best in FIG. 1C.

Hereinafter, in describing further embodiments or aspects of the invention, like features bear like designations.

Figure 2A:
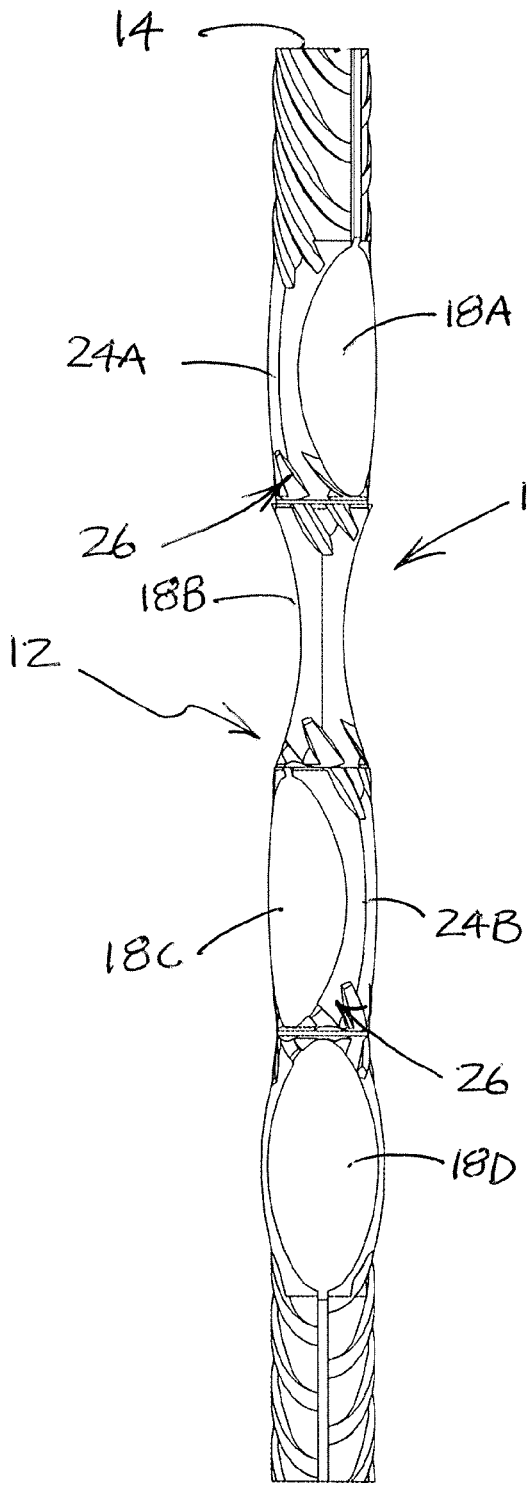
Figure 2B:
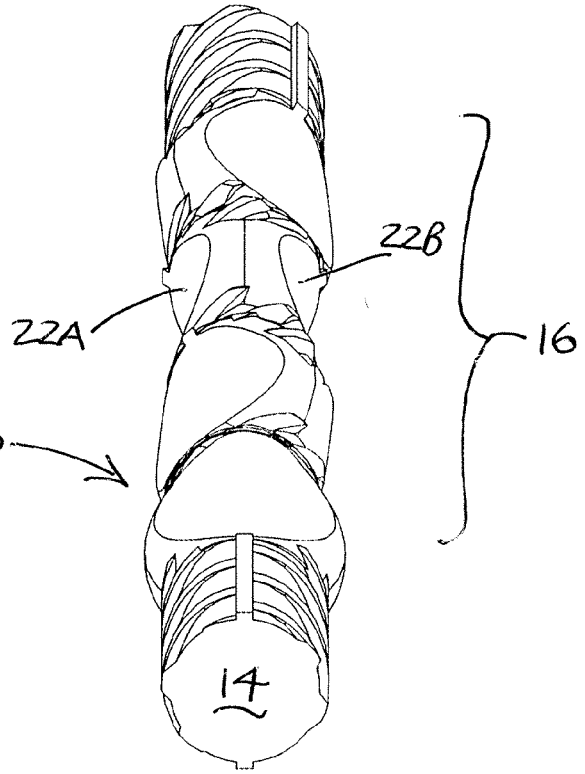
Figure 2C:
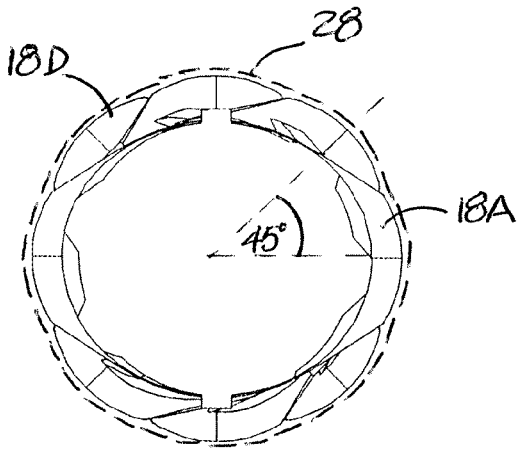

In a second embodiment of the first aspect of the invention, a rock bolt 10B, illustrated in FIGS. 2A to 2C, is provided. This bolt has four paddle formations, respectively designated 18A to 18D, included in the integral anchor portion 16, with each of the formations phase rotated through 45° as best illustrated in FIG. 2C.

When the bolt (10A or 10B) is inserted in a rock hole and a resin or grout is introduced, pre or post insertion, to adhere the bolt in the hole, and load is applied to the bolt, either passively through rock movement or actively by imparting preload directly to bolt, the paddle formations 18 resistively interact with the grout. In other words, a pulling force is experienced by the bolt, which is resisted by the paddle formations, and more specifically, by the grout pressing surfaces 26, pressing on the hardened grout or resin.

By radially offsetting the paddle formations in the manner of the invention, i.e. not orthogonally, no adjacent or nearly spaced paddle formation is in the shadow of a preceding paddle formation, when viewed in plan. Thus, each paddle formation 18, and the grout pressing surfaces 26 that they present, acts on a part of the grout that has not been acted upon by another peddle formation in the series.

Full (in the case of the rock bolt 10B) or substantially full (in the case of rock 6 bolt 10A) grout interaction is achieved in an annular zone about the rock bolt body, in the aggregate, by the radially offset paddle formations. The annular zone is defined within a dotted line, designated 28, on FIGS. 1C and 2C.

The rock bolt 10A does not achieve full grout interaction as, viewed in plan, there are columnar spaces 30 of grout that are not acted upon by any of the lobes 20 of the paddle formations 18.

By rotating the alignment of each paddle formation relative to the preceding paddle, by an angle that is not orthogonal, the integral anchor portion spreads the stress, imparted into the anchoring medium by the peddle formations, more evenly along the length of the portion and ensures that the zone of influence (hereinafter referred to as the "stressed zone") from each paddle formation, when under load, does not interact with the stressed zone created by a preceding paddle formation i.e. the paddle formation does not act in the shadow of the preceding paddle formation.

This configuration not only increases the ultimate load carrying capacity of the bolt, due to improved anchorage, but also, surprisingly, the stiffness when installed. As a result of the increased stiffness of the installation, the bolt is better able to maintain the integrity of the supported rock mass.

In other words, the invention provides a grout or resin bolt which has improved anchoring and stiffness features when anchored in a rock hole with a resinous or cementitious adhesive. With these improved parameters, the rock bolt of the invention will have the same support performance as a larger diameter bolt without the unique configuration of the paddle formations in the integral anchor portion. Thus, a smaller diameter bolt can be used, reducing the amount of steel and therefore cost, without compromising on performance.

Figure 3:
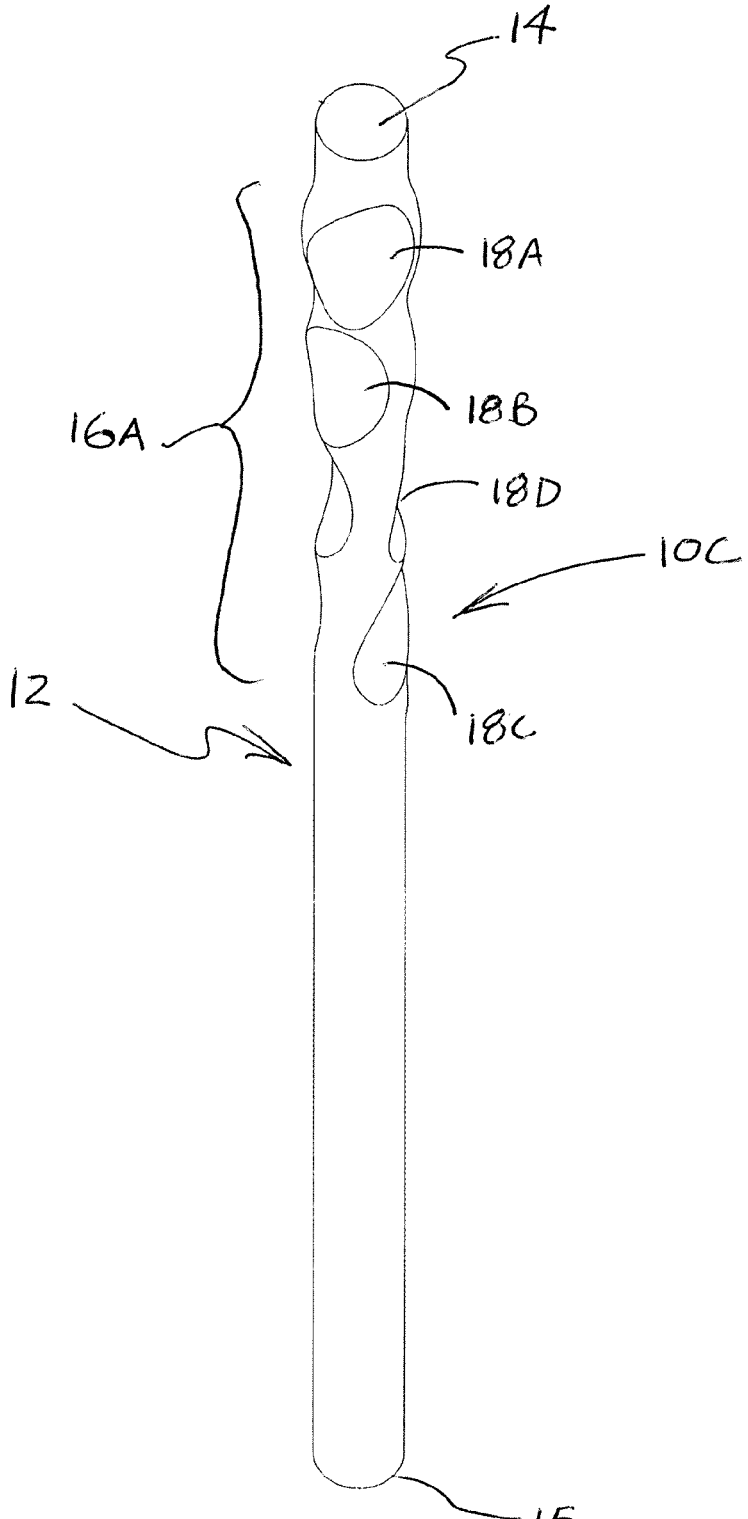
FIG. 3 is an isometric view of a grout anchored rock bolt in accordance with a second aspect of the invention.
Figure 4:
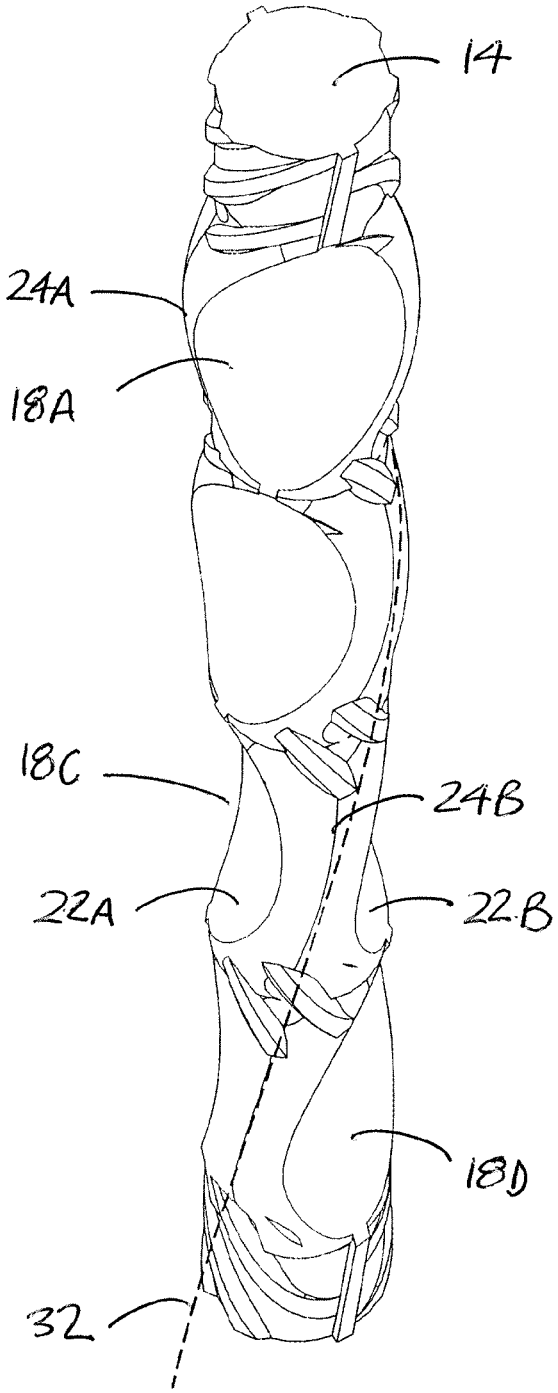
FIG. 4 is an isometric view of a leading end portion of the rock bolt of FIG. 3.
Figure 5:
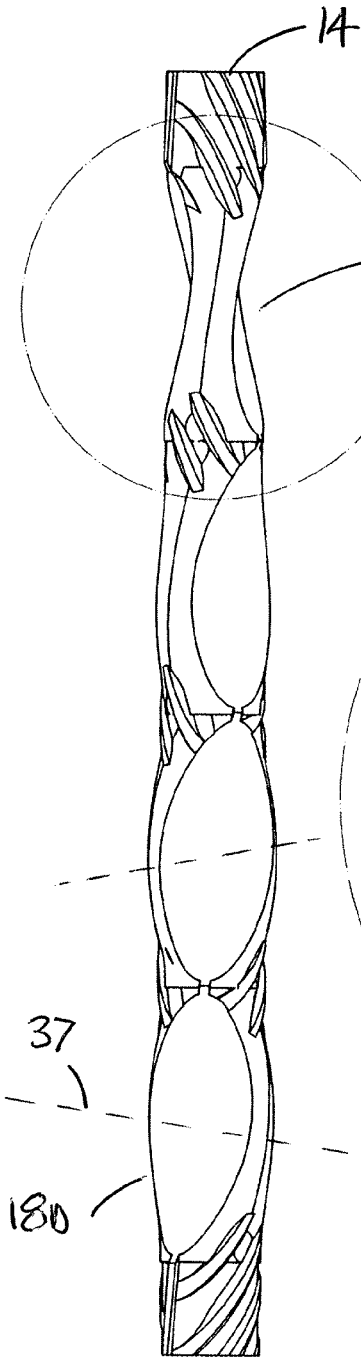
FIG. 5 is a view in elevation of the leading end portion of the rock bolt of FIG. 4.

FIGS. 3 to 5 illustrate a rock bolt 10C in accordance with a second aspect of the invention, which, in use, is adhered in a rock hole by a resinous or cementitious adhesive.

The rock bolt 10C has a solid cylindrical steel body 12, which extends between a first leading end 14 and an opposed end 15 (see FIG. 3) which latter end will, in use, project from a rock hole in which the bolt is placed. The surface of the bolt can be profiled for increased resistive interaction with the grout in use or smooth for yielding along the smooth portions.

In this example, the bolt 10C has a single integral anchor portion 16A disposed towards the distal end 14. This is the most important location for an anchor portion as it is along this distal end portion of the bolt that the supportive functionality of the bolt is focussed. This portion 16A comprises a twisted series of paddle formations which, in this example, is a set of four formations which are respectively designated 18A, 18B, 18C and 18D.

Unlike with the paddle formations of the first aspect of the invention, these paddle formations, intra and inter, have a twisted configuration that comes about employing one of two methods of the invention; a twisting method and a forming method. Each method will be described in turn.

Initially, each paddle formation 18 is formed by flattening the body 12, by any suitable cold forming means, such that the body expands in opposed directions which are orthogonal to the direction of the flattening force. This flattening process adapts the cylindrical rock bolt body to locally exceed its diameter in two diametrically opposed radial directions. In this way, each formation is provided with the first and second faces (22A and 22B) and the first and second edges (24A and 24B). These steps are illustrated in FIGS. 6A to 6D. Prior to twisting, however, all the paddle formations 18 are orientated in one plane and the edges are aligned in the longitudinal axis of the body (see FIG. 6D).

In the first aspect of the invention, the faces 20 will present perpendicularly to the rotational direction of the spinning bolt, when spun in the resin in use, with the concomitant disadvantages described in the background. In the present aspect, not only are the paddle formations 18 not orthogonally offset, as with the bolts (10A and 10B), they also do not present front-on to passage through the resin.

Figure 5A:
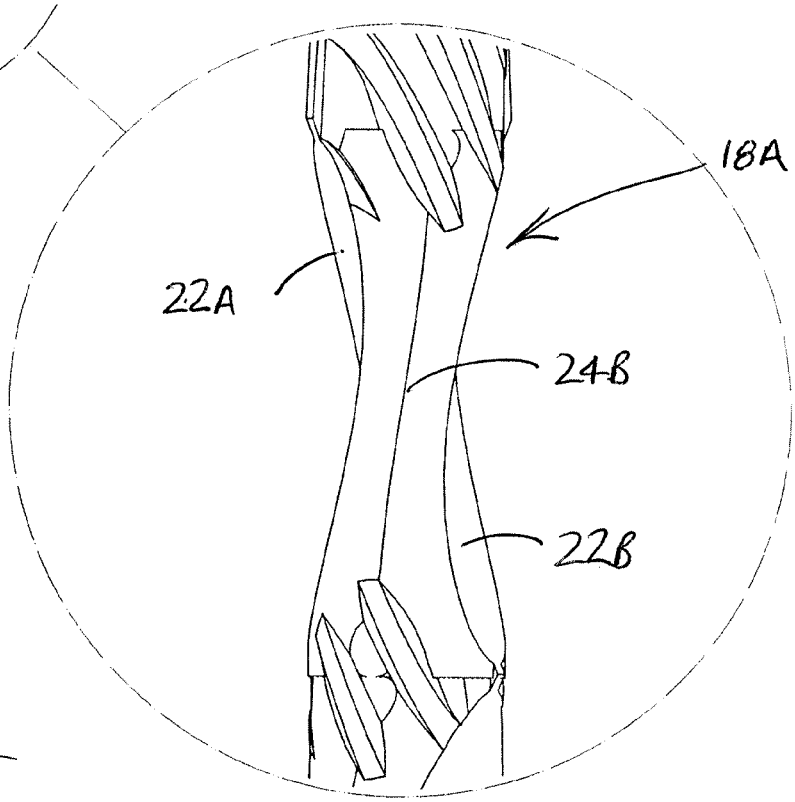
FIG. 5A is an insert illustrating one of the paddle formations of the rock bolt of FIG. 5.
Figure 6A:
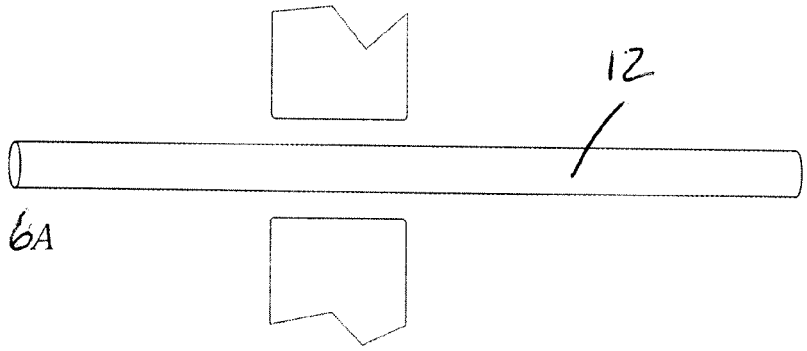
FIGS. 6A to 6E are a series of diagrammatic illustrations consecutively showing the steps in a first method of manufacturing the rock bolt of FIG. 3.
Figure 6B:
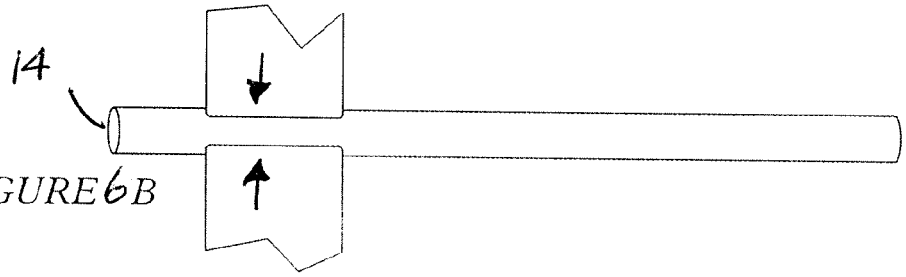
Figure 6C:
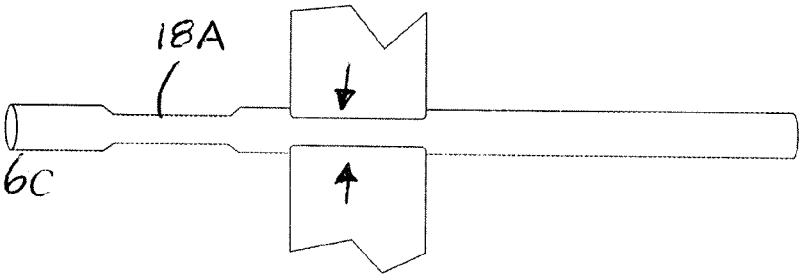
Figure 6D:
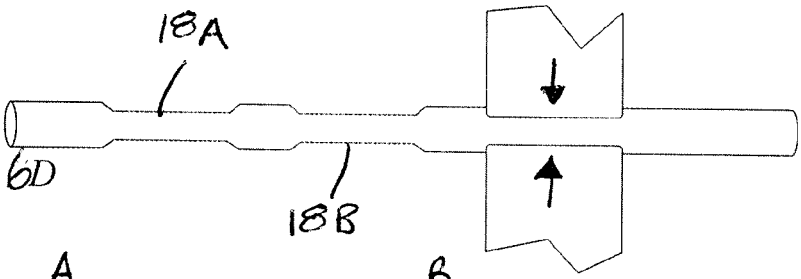
Figure 6E:
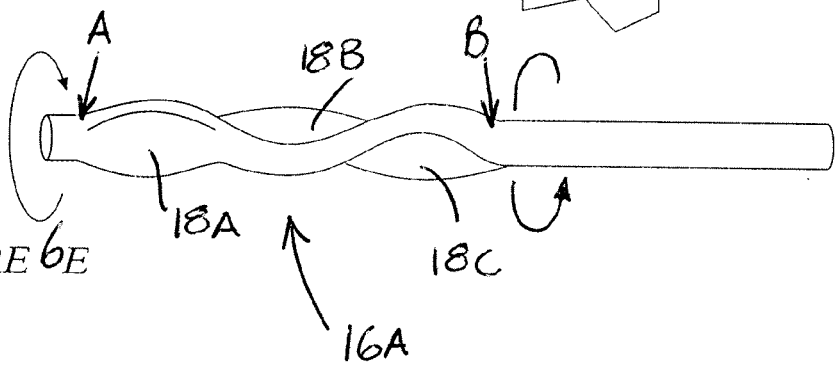

To achieve the non-orthogonal offset orientation of the paddles and to provide for the curvilinear surface of each of the faces 22, as best illustrated in FIG. 5A, the rock bolt is twisted. The twisting step is illustrated in FIG. 6E. This twisting can be achieved by gripping the bolt body 12 at two locations, for example at spaced locations designated A and B on FIG. 6E, on either side of the anchor portion 1A. Torque can then be applied to the bolt at both locations, in opposite directions or at one of these locations, whist holding the bolt at the other location to prevent spin.

Whilst only one potential embodiment of this aspect of the invention is illustrated in detail in FIGS. 3 to 5, i.e. the embodiment with four paddles 18 in the integral anchor portion 16A, a further preferred embodiment exists which has three paddle formations in the anchor portion. This embodiment is not illustrated in any amount of detail save for the diagrams of FIG. 6. However, this embodiment is analogous in all aspects to the illustrated embodiment, save the number of paddles and the degree to which the body is twisted to achieve non-orthogonal phase rotation and a twisted configuration.

If the rock bolt includes four paddle formations, the body 12 is twisted to an extent where a lateral centre 37 (illustrated in dotted outline in FIG. 5) of a fourth paddle formation 180 of the plurality is offset at 135∞ relatively to a first paddle formation 18A of the plurality, the result is that the series of four paddle formations will each be orientated at 45° relatively to adjacent formations. In this manner, a series of paddle formations with a phase rotation of 45° is achieved.

If the body 12 is twisted to an extent where a lateral centre of a third paddle formation of the plurality is offset at 120° relatively to a first paddle formation of the plurality, the result is that the series of three paddle formations will each be orientated at 60° relatively to adjacent formations. In this manner, a series of paddle formations with a phase rotation of 60° is achieved.

These non-orthogonal angles of 45° and 60° have been shown to have a stiffening effect on the bolt when installed when compared to orthogonal offset of the paddle formations. In addition, the twisting action distorts the originally planar faces 22, curving the faces to allow for a more streamlined passage of resin over the face, minimizing void formation behind a trailing face 22.

With the bolt twisted in this manner the edges (24A or 24B), in combination, follow a respective helical line which is designated 32 on FIG. 4.

In the forming method to achieve the twisted configuration of the paddle formation, which is illustrated in FIGS. 7A to 7E, a pair of dies 34 is used to form the cylindrical steel body 12 with paddle formations 18 that have curvilinear or twisted faces 22. Each die is complementarily shaped with a curved die surface 36.

Figure 7A:
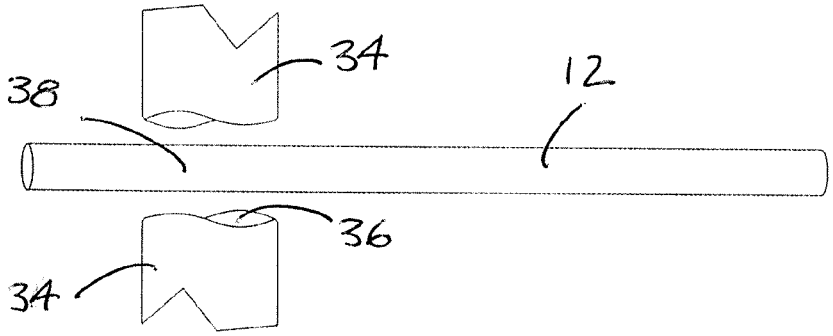
FIGS. 7A to 7E are a series of diagrammatic illustrations consecutively showing the steps in a second method of manufacturing the rock bolt of FIG. 3.
Figure 7B:
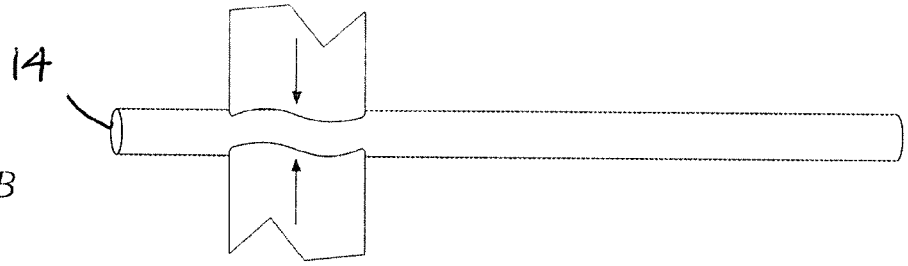

Along a first length 38, the body 12 is pressed between the dies, either one die moving and the other stationary or both moving together as illustrated with directional arrows in FIG. 7B. This action forms a first paddle formation 18A with twisted or curved faces 22.

Figure 7C:
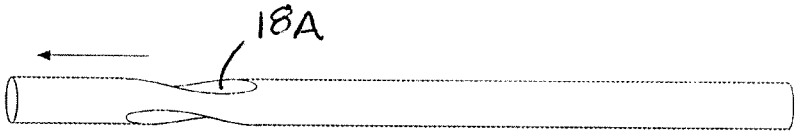
Figure 7D:
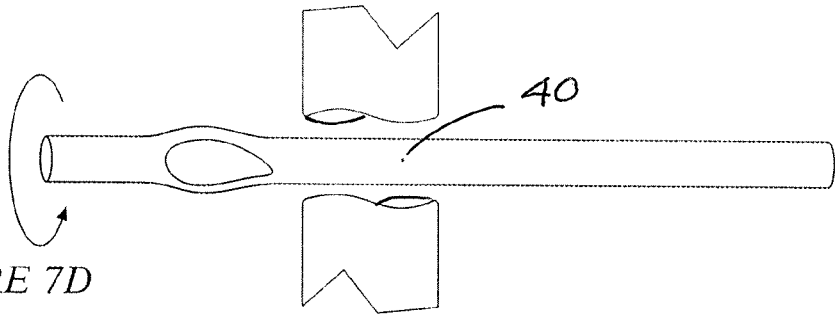
Figure 7E:
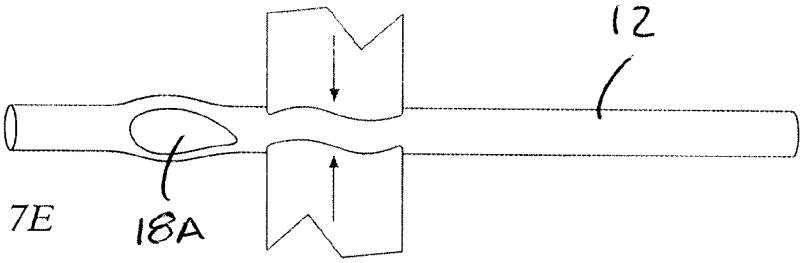

The body 12 is then shifted along and turned through 60° or 45°, depending upon whether three or four formations respectively are going to be formed, to present a second length 40 to the action of the dies. These steps are illustrated in FIGS. 7C and 7D. Again, the dies press a second paddle formation 18B (FIG. 7E). Further formations are formed by repeating the steps although these subsequent steps are not illustrated for ease of illustration and explanation.

It is contemplated that the single integral anchor portion 16A can be formed with a plurality of the curvilinear paddle formations 18 in a single forming process. In this method, a multiple die tool is used that includes 3 or 4 dies that are simultaneously actuated in multiple planes on the body 12 to form the anchor portion 16A.

And so, by twisting or forming the bolt body 12 as described above, each peddle formation 18 will have a twist induced in each of the faces 22 and edges 24 or a curvilinear surface pressed into the body to provide the faces 22 such that, synergistically across its length, this anchor portion 16A will function like an auger; drawing resin along the bolt, towards the top of the hole. With the top portion of the hole supplied with sufficient resin, the rock bolt is anchored along the critically important part of the bolt body i.e. the leading end portion, whilst creation of voids due is reduced due to improved resin flow across the faces.

Figure 8:
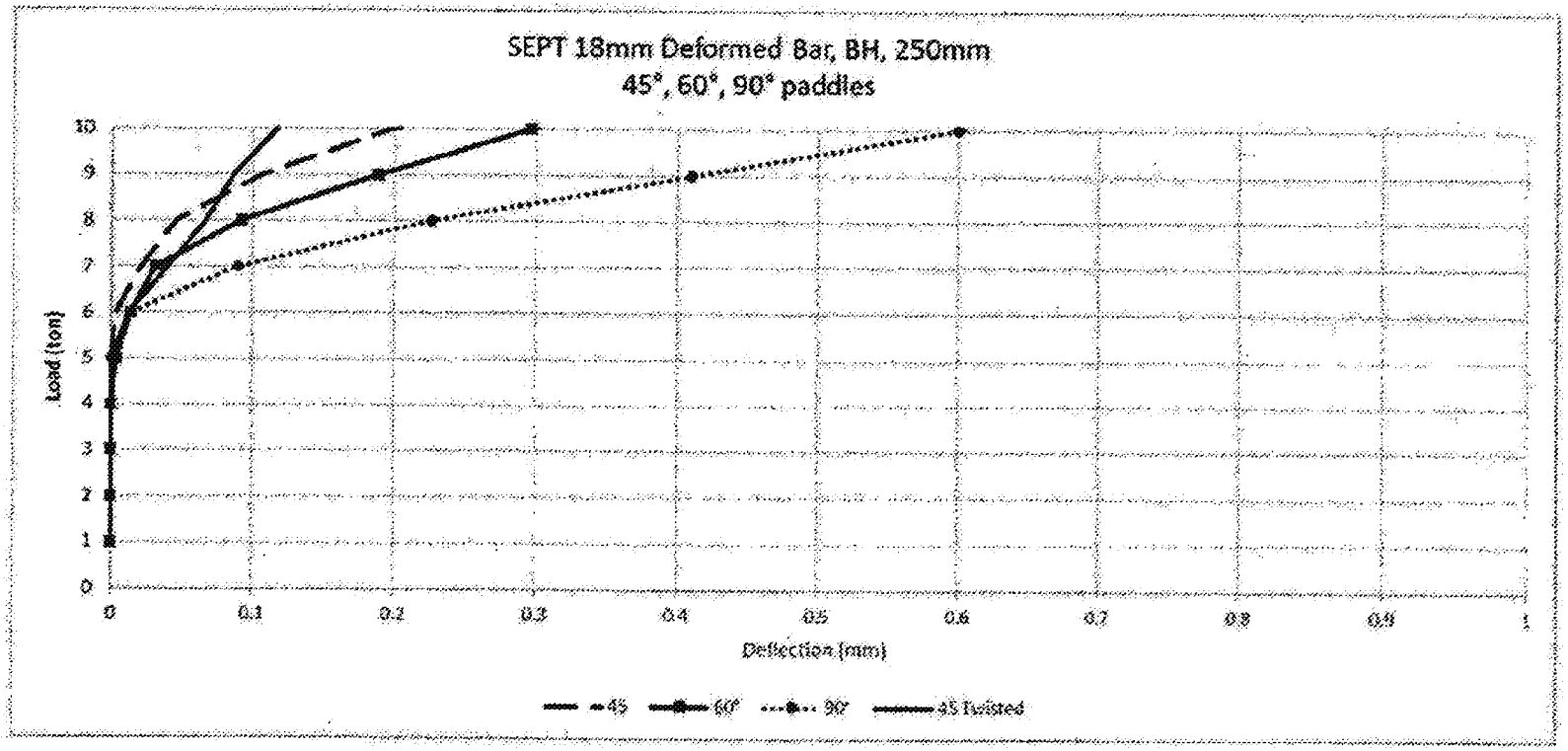
FIG. 8 is a graph of results of deflection tests done on the rock bolts of FIG. 1 and FIG. 3 and a rock bolt of the state of the art.

To confirm that stated advantages, the applicant undertook a comparative test in which three 16 mm rock bolts were inserted in a 38 mm test hole and grouted therein. Each bolt had a series of three paddle formations that differed in their configuration. Each bolt was progressively loaded under tension (y axis) and the degree of deflection or stiffness is measured (x axis). The results of the tests are graphically represented in FIG. 8.

A first bolt (represented by the - - - - line) was configured in terms of the first aspect of the invention to have paddles prior art, having paddles radially offset by radially offset by 45°. A second bolt (represented by the -■- line) was configured in terms of the first aspect of the invention to have paddles radially offset by 60°. A third bolt (represented by the -•- line) was configured in terms of the prior art to have paddles radially offset by 90°. And, a fourth bolt (represented by the --- line) was configured in terms of the second aspect of the invention to have twisted paddles, helically arranged, and radially offset by 45°.

From the results, it is evident that the first and the second rock bolts, which accord with the first aspect of the invention, exhibit significantly improved load support capacity when compared with a state of the art paddled bolt i.e. the first bolt. And moreover, the fourth bolt exhibits improved support capacity over, not only the state of the art, but its contemporaries.

The invention claimed is:

1. A grout anchored rock bolt comprising:

an elongate cylindrical body of a material which has at least one integral anchor portion which comprises a plurality of projections, each of the plurality of projections extending laterally from the body in at least one radial direction, the projections being consecutively serially arranged along the length of the anchor portion, each of the projections being radially offset relatively to a preceding formation at an angle that is not orthogonal, wherein each projection is a lobed formation, aligned in the longitudinal axis of the body, and extending laterally from the body in one radial direction.

2. A grout anchored rock bolt comprising:

an elongate cylindrical body of a material which has at least one integral anchor portion which comprises a plurality of projections, each of the plurality of projections extending laterally from the body in at least one radial direction, the projections being consecutively serially arranged along the length of the anchor portion, each of the projections being radially offset relatively to a preceding formation at an angle that is not orthogonal, wherein each projection is a paddle formation, aligned in the longitudinal axis of the body, and extending laterally from the body in two diametrically-opposed radial directions.

3. A grout anchored rock bolt comprising:

an elongate cylindrical body of a steel material which has at least one integral anchor portion which comprises of a plurality of serially arranged paddle formations, to provide opposed first and second faces and opposed first and second edges separating the faces, wherein each of the formations is radially offset relatively to the preceding formation at an angle that is not orthogonal, and wherein the edges follow a helical pattern.

4. The grout anchored rock bolt according to claim 3, wherein each of the paddle formations extends laterally from the body in two opposed radial directions.

5. The grout anchored rock bolt according to claim 3, wherein the plurality of serially arranged paddle formations are consecutively serially arranged.

6. The grout anchored rock bolt according to claim 3, wherein the integral anchor portion comprises either three or four paddle formations radially offset in a range 55° to 65° and 40° to 50°, respectively.

7. The grout anchored rock bolt according to claim 6, wherein the integral anchor comprises four paddle formations radially offset at 45°.

8. The grout anchored rock bolt according to claim 6, wherein the integral anchor comprises three paddle formations radially offset at 60°.

9. The grout anchored rock bolt according to claim 3, wherein the body includes a first integral anchor portion and a second integral anchor portion.

10. The grout anchored rock bolt according to claim 9, wherein the first anchor portion is positioned towards a first end of the body and the second anchor portion is positioned towards a second end of the body.

11. A method of manufacturing a paddle adapted rock bolt with improved grout installation properties, the method comprising:

providing an elongate cylindrical body of a suitable steel material;

flattening the body at intervals along a length of the body to form three paddle formations, all of the paddle formations extending laterally from the body in a single plane; and twisting the body about an elongate axis of the body to twist the paddle formations out of the single plane, the body, with the three paddle formations, is twisted to an extent where a lateral center of one of the paddle formations of the three paddle formations is radially offset at 120° relative to another of the paddle formations of the three paddle formations.

12. A method of manufacturing a paddle adapted rock bolt with improved grout installation properties, the method comprising:

providing an elongate cylindrical body of a suitable steel material;

flattening the body at intervals along a length of the body to form four paddle formations, all of the paddle formations extending laterally from the body in a single plane; and twisting the body about an elongate axis of the body to twist the paddle formations out of the single plane, wherein the body, with the four paddle formations, is twisted to an extent where a lateral center of one of the paddle formations of the four paddle formations is radially offset at 135° relative to another paddle formation of the four paddle formations.

13. A method of manufacturing a paddle-adapted rock bolt with improved grout installation properties, the method comprising:

providing an elongate cylindrical body of a steel material;

providing a pair of dies of a forming tool in which the dies are complementarily-shaped with a twisted surface;

pressing the body at a first location between the pair of dies to provide a first paddle formation with opposed faces, each of the opposed faces of the first paddle formation having a twisted surface;

turning the body about an elongate axis of the body through an angle that is not orthogonal; and pressing the body at a second location between the pair of dies to provide a second paddle formation with opposed faces, each of the opposed faces of the second paddle formation with a twisted surface.

14. The method according to claim 13, wherein the pressing the body at a first location, the turning the body about the elongate axis, and the pressing the body at the second location are repeated to provide a third paddle formation.

15. The method according to claim 14, wherein, in the turning the body about the elongate axis, the body is turned through 60°.

16. The method according to claim 13, wherein the pressing the body at a first location, the turning the body about the elongate axis, and the pressing the body at the second location are repeated to provide a third paddle formation and a fourth paddle formation.

17. The method according to claim 16, wherein, in the turning the body about the elongate axis, the body is turned through 45°.

* * * * *